United States Patent [19]

Holdeman

[11] 4,070,207

[45] Jan. 24, 1978

[54] METHOD OF PRODUCING POROUS COPPER WORKPIECES AND PRODUCT THEREOF

[76] Inventor: Louis B. Holdeman, 9 Diller Court, Boyds, Md. 20720

[21] Appl. No.: 733,813

[22] Filed: Oct. 19, 1976

[51] Int. Cl.[2] ..... C22F 1/02

[52] U.S. Cl. ..... 148/2; 148/3; 148/11.5 C; 148/13.2; 148/32; 148/130

[58] Field of Search ..... 148/2, 3, 11.5 C, 13.2, 148/20.3, 130, 32

[56] References Cited

U.S. PATENT DOCUMENTS

| | | | |
|---|---|---|---|
| Re. 26,960 | 10/1970 | Hess | 148/20.3 |
| 3,276,919 | 10/1966 | Todd | 148/20.3 |
| 3,546,029 | 12/1970 | Snyder et al. | 148/13.2 |

*Primary Examiner*—R. Dean

*Attorney, Agent, or Firm*—J. H. Beumer; L. D. Wofford, Jr.; J. R. Manning

[57] ABSTRACT

Porous copper workpieces are obtained by a. obtaining a copper workpiece having a selected grain size;

b. machining the workpiece to a selected size and shape;

c. electrochemically polishing said workpiece;

d. annealing said workpiece from step (c) in oxygen at a temperature from 750° to 1080° C. and a pressure of $10^{-4}$ – $10^{2}$ Torr; and e. annealing said workpiece from step (d) in hydrogen.

4 Claims, 3 Drawing Figures

METHOD OF PRODUCING POROUS COPPER WORKPIECES AND PRODUCT THEREOF

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates to copper workpieces having smaller pore size than hitherto obtainable and to a method of making such workpieces.

Porous plugs having pore sizes smaller than 10–15 microns are required as phase separators in vent lines of long hold-time liquid helium containers in a zero-gravity environment. Such containers are needed for experiments employing the cryogenic technology developed around superconductivity and the Josephson effects. In order to maximize liquid helium hold-time (and hence the lifetime of the experiment), it is essential to ensure that none of the liquid helium is lost through the vent lines along with the vapor, owing to liquid flotation in the conditions of low gravity.

Insertion of a porous plug separator into the vent line has been proposed as a solution to this problem. P. M. Selzer et al., "A Superfluid Plug for Space," Advances in Cryogenic Engineering, Vol. 16, p. 277, New York, Plenum Publishing Corp., (1971); E. W. Urban et al., "A Porous Plug for Control of Superfluid Heliumin Space," Proceedings of the Second Annual Research and Technology Review, George C. Marshall Space Flight Center, presented by the Research and Technology Office, Science and Engineering Directorate, NASA, p. 424, October 1974.

In addition, because of special properties of liquid helium below its superfluid transition at $T = 2.18$ K, a porous plug permits thermal control of the liquid. Such a plug should have a high thermal conductivity, and the channels through the plug should be large enough to maintain a flow rate below the critical velocity of superfluid helium in the channels yet small enough so that the heat conducted by the liquid is much less than the heat conducted by the plug material.

The usual procedures for making high thermal conductivity porous plugs is by "sintering" powdered metal. In this process suitably compacted metal powder is heated to just below the melting point of the metal, and the powder grains fuse together to form a porous solid. The average pore diameter in this porous solid is largely determined by the average diameter of the metal granules in the powder. A shortcoming of this technique is that channel size and the ratio of the average total area of the channels to the average cross-section of metal cannot be controlled independently. The smallest average pore size in plugs available for testing to date is 10 to 15 microns, although smaller pore sizes had been sought. Although ceramic plugs with pores 1 to 2 microns in diameter are available, ceramic materials have very poor thermal conductivity at liquid helium temperatures.

Todd, in U.S. Pat. No. 3,276,919, teaches that metal structures having very fine pores can be obtained from structures having courser pores, e.g., bundles of tungsten wires or compacted particles, by oxidizing the porous metal structure to coat each layer or particle with adherent metal oxide, which occupies a greater volume than the metal, and reducing the oxide to metal without contraction in volume to produce a porous cellular metal structure of greatly increased surface area. The Todd process is therefore a modified sintering process.

Synder et al (U.S. Pat. No. 3,546,029) shows the use of a reducing gas to remove heavy surface oxide or scale from a copper rod, without any effect other than at the surface.

Hess (U.S. Pat. No. Re. 26,960) prevents the formation of scale on steel or copper by heating with a stoichiometric mixture of fuel and combustion supporting gas containing oxygen until the metal reaches scaling temperature, changing to a fuel-rich mixture, and heating to the desired temperature. No interior modification is noted.

Thus, available technology for making metal workpieces of very small pore size is based on modification of substrates already having, to some extent, a porous structure and does not provide the very small pore sizes, below 10–15 microns, required for plug separators in vessels for crycgenic use.

SUMMARY OF THE INVENTION

In a process aspect, this invention relates to a method of preparing copper workpieces of average pore diameter below 10 – 15 microns by the steps of:

a. obtaining a copper workpiece having a selected grain size;
b. machining the workpiece to a selected size and shape;
c. electrochemically polishing said workpiece;
d. annealing said workpiece from step (c) in an oxygen atmosphere at 750°– 1080° C. and $10^{-4}$ – $10^{2}$ Torr for 2 – 72 hours, and
e. annealing said workpiece from step (d) in hydrogen at 750°– 1080° C. and $10^{-3}$ – $10^{+3}$ Torr for 2 – 72 hours.

In a product aspect, this invention relates to a copper workpiece having an average pore size or diameter below 10 – 15 microns.

In another product aspect, this invention relates to a copper workpiece having a pore diameter below 10 – 15 microns, obtained by the process of this invention.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

It is an object of this invention to provide porous copper workpieces of which the average pore diameter is below 10 – 15 microns. It is a further object of this invention to provide a method for preparing aforesaid workpieces

DETAILED DESCRIPTION

"Grain," as used in the specification and claims, refers to the individual crystalites of which a solid piece of copper is composed. "Workpiece" means a solid piece of copper of specified grain or crystallite size which is fabricated by machining, or by equivalent mechanical processes. One such process would be casting the workpiece in its final shape in an appropriate mold, in which case steps (a) and (b) of the abstract would be combined and step (c) would be eliminated.

The workpieces of this invention can be In the form of a plug, a disc, or a more complicated shape, for use as heat exchangers, phase separators, fluid and gaseous flow control elements, etc.

After machining the workpiece is electrochemically polished. The purpose of the electrochemical polishing step is to remove any surface damage which may have resulted from the machining step, and to expose the individual grains at the surface of the workpiece. Techniques of electrochemical polishing are standard and are well known to persons skilled in the art. One suitable technique is described in the *Metal Finishing Guidebook and Directory,* 41 Annual Edition, published by Metals and Plastics Publications, Inc.

The plug as a whole will be larger after firing in hydrogen than before firing owing to grain boundary separation. If the copper plug is in the shape of a disk, a ring of oxygen-free high conductivity (OFHC) copper can be machined and placed around the disk in the furnace before heating in hydrogen. The inner diameter of the OFHC ring is slightly less than the outer diameter of the disk will be after annealing in hydrogen. During firing, the plug expands into the OFHC ring and thus is permanently mounted in a retainer ring of which the expansion coefficient perfectly matches that of the plug at all temperatures. The plug can then be installed by standard techniques, e.g., soldering, indium O-ring seal, without changing the effective cross-section of the plug.

Figure 1:
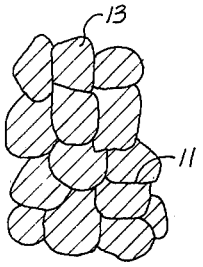
In FIG. 1 is depicted the grain structure of individual workpieces before treatment in accordance with this invention, In FIG. 2 is shown the internal structure of a workpiece after annealing with oxygen in accordance with step (d), In FIG. 3 is shown the product of this invention, after step (e).

The grain structure of the initial workpieces prior to treatment in accordance with the present invention is illustrated in FIG. 1 as being composed of a plurality of grains 13 separated by grain boundaries 11 having a mis-matched lattice structure. The desired grain size of the initial workpiece may be obtained by controlling the number of grains produced when forming the workpieces. The number of grains being determined by the type and amounts of impurities present and, perhaps most importantly, the cooling or cure rate of the workpiece when being formed by conventional techniques such as by molding.

Figure 2:
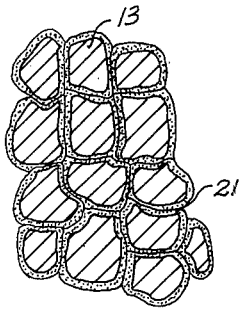

At the end of the oxygen annealing step, the copper is thought to have a structure essentially as represented by FIG. 2, in which the grain is shown as 13 and the portion at 21 is precipitated oxidic impurities at the grain boundaries. The basis for this proposed structure is that copper has a very low free energy of surface oxidation. If copper is heated at an oxygen pressure of $10^{-2}$ Torr or less, oxygen diffuses into the bulk to form a solid solution, rather than forming a surface oxide. However, impurities in the copper having a higher free energy of oxidation are oxidized. This process of oxygen annealing is commonly used to produce copper of high "electrical" purity. F. R. Frickett, "Oxygen Annealing of Copper: A Preliminary Review," sponsored by: International Copper Research Association, 825 Third Avenue, New York, N.Y. 10022 (1972).

After the heating step in the oxygen annealing process, the oxidized impurities precipitate out at the grain boundaries under controlled cooling conditions. Impurities commonly added to copper include aluminum, chromium, lead, and bismuth. In addition, oxides of copper may also precipitate at the grain boundaries. Preferably, the workpiece is cooled from the annealing temperature to room temperature at a rate of from 10°–100° C. per hour. Other controlled cooling techniques may be utilized for curing the workpiece after annealing to precipitate out the oxides at the grain boundaries such as a modified precipitation hardening technique described in *Physical Metallurgy for Engineers,* Clark and Varney, Second Edition, 1962.

The structure represented by FIG. 2 can also be obtained when the oxidation step is carried out at pressures greater than the dissociation pressure of copper oxides, owing to the fact that the activation energy for diffusion of the oxygen along grain boundaries is smaller than the activation energy for lattice diffusion.

The oxygen-annealed workpiece can be annealed with hydrogen in the same furnace used for the oxygen anneal step by exhausting the oxygen and replacing it with hydrogen or can be transferred to another furnace.

It is thought that, in this step, hydrogen diffuses into the copper and reacts with precipitated oxides at the boundaries to produce separation at the grain boundaries. Uncontrolled separation at grain boundaries occurs occasionally in commercial grade copper when fired in a hydrogen brazing furnace and is generally prevented by specifying OFHC (oxygen free high conductivity) copper for copper parts which are to be joined by brazing in a hydrogen furnace.

Unlike the Todd process, supra, the process of this invention makes a porous material from a single piece of impermeable material by exploiting the fact that, because of its low free energy of oxide formation, copper does not form oxides when heated in oxygen at very low pressures. Instead, oxygen may oxidize impurities in the copper, but not copper itself. As the temperature of the copper is lowered, it is thought that the solution becomes "supersaturated" and copper oxide begins to form inside the copper, which along with the impurity oxides, precipitates out at the grain boundaries of the crystallites under the controlled cooling conditions. The amount of impurity and copper oxides formed at the grain boundaries determines the amount of grain boundary separation during annealing in hydrogen and hence the channel size and porosity.

Figure 3:
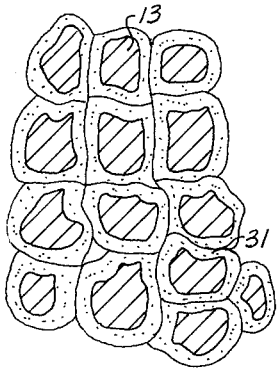

Thus, the copper is still impermeable at the end of the oxidation step. Metal oxide has precipitated at the grain boundaries. The metal becomes porous when the hydrogen reacts with these precipitated oxides during the reduction step and causes grain boundary separation, as shown in FIG. 3, wherein 31 represents a channel thus formed in the metal body.

In the Todd patent, supra, it is suggested that the porosity observed after hydrogen annealing is due solely to the difference in specific volume of the reduced copper and the copper oxide. This is not the case. First, workpieces of commercial copper which underwent uncontrolled grain boundary separation during hydrogen brazing were observed to have measurably larger dimensions after firing in hydrogen. Second, Fickett (op. cit. p. 6 and pp. 19–20) reports grain boundary separation after oxygen annealing for a copper sample containing hydrogen. According to Todd, supra, neither of these results would be observed. It thus appears that the observed grain boundary separation is due in part to energy release during the reaction $2H_2 + O_2 \rightarrow 2H_2O$.

Although the product of this invention is not restricted to such, the principal application of said product will be in the area of control of liquid helium in a zero-gravity environment. Porous plug thermal control of liquid helium is the subject of on-going experimental research (see, for example: "Helium II Flow Through Vapor Separation by Porous Plugs," by W. E. Urgan, L. Katx, and G. R. Karr, in *Low Temperature Physics - LT* 14, Volumn 4: *Techniques and Special Topics,* M. Krusius and M. Vuorio, Editors (American Elsevier Publishing Co., New York 1975, p. 37, and the ideal ratio of channel area to metal area has not been established.

In the products of this invention, the ratio of channel area to metal area can be varied by controlling the grain size and grain shape in the initial workpiece, and/or the extent of grain boundary separation. Grain sizes in metals can be made to vary in size from sizes visible to the naked eye to sizes barely resolved by optical microscope, by known techniques. Such techniques include, but are not necessarily limited to, controlling impurity content of the beginning workpiece, type of impurity, liquid and mold temperature upon casting, relative masses of liquid and mold, mold thermal conductivity, rate of cooling, and direction of cooling.

Grain boundary separation can be controlled by the amount of oxides precipitated at the grain boundaries which may be controlled by techniques including, but not necessarily limited to, impurity content, type of impurity included, oxygen pressure during oxidation, temperature during oxidation, and most importantly, by the cooling rate after oxidation as discussed above. To a lesser extent, the grain boundary separation can be controlled by cooling rate after hydrogen reduction.

DESCRIPTION OF A PREFERRED EMBODIMENT

In a preferred embodiment, the copper workpiece is a thin copper disk having columnar-grained structure with axes of the columnar grains perpendicular to the flat surfaces of the disk. Said workpiece is obtained, for example, by pouring liquid copper superheated well above its melting temperature into a cold iron mold, or by machining from a columnar-grained ingot obtained in this manner. (See, for example, *Structure and Properties of Alloys,* by R. M. Brick, R. B. Gordon, and A. Phillips (McGraw-Hill, Inc., New York, 1965), section 3.2, pp. 72–75). The size of the disk can vary, but for a specific example, the disk shall be one inch in diameter by one-sixteenth inch thick. Oxidation along grain boundaries is by direct oxidation along grain boundaries via greater rate of diffusion along grain boundaries as compared to lattice diffusion (higher oxygen pressure range) or by controlled cooling of disk containing dissolved oxygen to precipitate copper oxide at the grain boundaries. An OFHC copper ring one-sixteenth inch thick is placed around the disk, said ring having an inner diameter greater than that of the disk by approximately five-thousandths of an inch. The disk is then heated for approximately 2 hours in hydrogen at approximately 1,000° C. and atmospheric pressure. Ring and disk are mounted in test apparatus as described by Urban, Katz, and Karr, supra, or soldered, brazed, or otherwise mounted in the vent line.

In another preferred embodiment, this invention relates to porous copper workpieces obtained by the preferred process.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

What is claimed is:

1. A method of making porous copper workpieces of average pore diameter below 10 – 15 microns comprising the steps of:

a. obtaining a copper workpiece having a selected grain size;
b. matching the workpiece to a selected size or shape;
c. electrochemically polishing said workpiece;
d. annealing said workpiece from step (c) in an oxygen atmosphere at 750° – 1080° C. and $10^{-4}$ – $10^{2}$ Torr for 2 – 72 hours; and
e. annealing said workpiece from step (d) in hydrogen at 750° – 1080° C. and $10^{-3}$ – $10^{+3}$ Torr for 2 – 72 hours.

2. The method as set forth in claim 1 wherein said workpiece is cooled following annealing in oxygen at a rate of 10° – 100° C. per hour.

3. The method as set forth in claim 1 further comprising mounting said workpiece in a retainer piece prior to annealing in hydrogen.

4. The method of claim 3 wherein said retainer piece is provided by a ring of oxygen free high conductivity copper placed around the workpiece into which said workpiece expands during heating in hydrogen producing a porous copper plug having a substantially unchanging effective cross-section at varying temperature.

* * * * *